US007107001B2

(12) United States Patent
Kameda

(10) Patent No.: US 7,107,001 B2
(45) Date of Patent: Sep. 12, 2006

(54) FIXING APPARATUS WITH CONTROLLED HEATING MEMBERS FOR HEATING THE OUTER SURFACE OF THE FIXING ROTATING MEMBER

(75) Inventor: Seiichiro Kameda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/087,706

(22) Filed: Mar. 24, 2005

(65) Prior Publication Data

US 2005/0214043 A1 Sep. 29, 2005

(30) Foreign Application Priority Data

Mar. 29, 2004 (JP) ..... 2004-095868

(51) Int. Cl.
*G03G 15/20* (2006.01)

(52) U.S. Cl. ..... 399/328; 399/330; 399/335; 399/67; 399/69

(58) Field of Classification Search ..... 399/328, 399/330, 335, 67, 69
See application file for complete search history.

(56) References Cited

U.S. PATENT DOCUMENTS

RE35,923 E * 10/1998 Mitsuya ..... 399/69
6,473,579 B1 10/2002 Suzuki et al. ..... 399/124
6,799,000 B1 * 9/2004 Aslam et al. ..... 399/69
2005/0207771 A1 9/2005 Kameda ..... 399/68
2005/0214043 A1 9/2005 Kameda ..... 399/328

FOREIGN PATENT DOCUMENTS

JP 10-149044 6/1998
JP 2004-37555 2/2004

OTHER PUBLICATIONS

Machine translation of Japanese Patent JP 10-149044 (Mitsuhiro et al.).*

* cited by examiner

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

The present invention provides an external heating member abutment controller which can instantaneously adjust the quantity of heat provided by external heating members to the surface of a fixing member, to provide a fixing apparatus which can drastically increase productivity for cardboards and which can provide high-quality color images free from variations in gloss (gloss nonuniformity). Thus, a fixing apparatus according to the present invention comprises a first and second fixing rotating members that use nip portions to thermally fix a toner image on a recording material and a first and second heating members that abut against the first fixing rotating member to heat an outer surface of the first fixing rotating member. The fixing apparatus is characterized in that when a fixing operation is started, the first heating member and the second heating member are sequentially abutted against the first fixing rotating member.

9 Claims, 6 Drawing Sheets

[RETRACTION CONDITION OF BOTH FIRST AND SECOND EXTERNAL HEATING ROLLERS 53 AND 54]

[CONDITION OF FIRST EXTERNAL HEATING ROLLER 53 PREVIOUSLY ABUTTING]

[CONDITION OF SECOND EXTERNAL HEATING ROLLER 54 ALSO SUBSEQUENTLY ABUTTING]

[RETRACTION CONDITION OF BOTH FIRST AND SECOND EXTERNAL HEATING ROLLERS 53 AND 54]

[CONDITION OF ABUTTING FORCE OF FIRST AND SECOND EXTERNAL HEATING ROLLERS 53 AND 54 SEQUENTIALLY INCREASING]

[CONDITION OF ABUTTING FORCE OF FIRST AND SECOND EXTERNAL HEATING ROLLERS 53 AND 54 BECOMING SUBSTANTIALLY SAME]

FIXING APPARATUS WITH CONTROLLED HEATING MEMBERS FOR HEATING THE OUTER SURFACE OF THE FIXING ROTATING MEMBER

BACKGROUND OF THE INVENTION

1. Field of the Invention

The present invention relates to a fixing apparatus for use in a printer, copier, facsimile machine, or the like which employs an electrophotographic system or an electrostatic recording system.

2. Related Background Art

Various image forming apparatuses are conventionally known. Of these image forming apparatuses, those based on an electrophotographic system have prevailed which exposes a photosensitive member to laser light and which then develops an image. Such an image forming apparatus has advantages such as a high image quality and high-speed operations and is widely used as, for example, an output apparatus such as a copier or a color laser beam printer.

The color image forming apparatus such as a copier or a color laser beam printer has been requested to achieve high productivity (the number of prints per unit time) using various sheets (recording materials) such as cardboards.

In order to increase the productivity of the image forming apparatus to which the electrophotographic system is applied, notably in connection with paper with a heavy basic weight, it is necessary to increase the fixing speed of a fixing apparatus. However, paper with a heavy basic weight absorbs much heat. Accordingly, such paper requires a significantly larger quantity of heat for fixation than thin paper. Thus, at present, when images are fixed to paper with a heavy basic weight, a fixing process is executed with a reduced fixing speed.

Thus, as a technique for enabling an increase in the speed at which color images are fixed, a fixing apparatus configuration has already been proposed which is disclosed in Japanese Patent Application Laid-Open Nos. H10-149044 and 2004-37555.

An image heating fixing apparatus according to Japanese Patent Application Laid-Open No. H10-149044 has paired fixing members disposed so as to be rotatable while in pressure contact with each other. An unfixed image is formed on a recording material at a nip portion formed by fixing member pair. While conveyed, the recording material is sandwiched between the fixing members to heat and fix the unfixed image. One or more external heating members can abut against and retract from the fixing member pair.

Further, Japanese Patent Application Laid-Open No. 2004-37555 discloses an external heating apparatus and a fixing apparatus using the external heating apparatus. The external heating apparatus comprises a plurality of external heating rolls that come into pressure contact with a surface of a heated member to externally heat the surface. The external heating apparatus has contacting and separating means for bringing the plurality of external heating rolls into pressure contact with the surface of the heated member and separating the external heating rolls from the surface and adjusting means for bringing the plurality of external heating rolls into uniform pressure contact with the surface of the heated member.

The above conventional techniques have the following problems. With the fixing apparatuses according to Japanese Patent Application Laid-Open No. H10-149044 and Japanese Patent Application Laid-Open No. 2004-37555, even if recording materials (referred to as transfer paper below) are cardboards, the following measure can be taken to realize a high productivity substantially equivalent to that for thin paper; the quantity of heat generated by the external heating rolls is increased to allow the external heating rolls to provide more heat to the surface of the heated member. However, with a mere increase in the quantity of heat provided by the external heating rolls, when the fixing apparatus fixes an image to transfer paper, if the external heating rolls provide a large quantity of heat to the surface of the heated member before the transfer paper enters a fixing portion, then the surface of the heated member becomes too hot. This causes toner on the transfer member to be excessively melted to make the toner too glossy. Thus, an attempt to control the external heating temperature or the temperature of the heated member cannot solve the above problems because of the insufficient thermal responsiveness of the external heating rollers or heated member.

Further, if an attempt is made to cause the external heating rolls to provide a quantity of heat to the surface of the heated member after the transfer paper has entered the fixing portion, the transfer paper absorbs heat from the heated member to make the heated member too cold. Consequently, the toner on the transfer paper cannot be melted and thus has a reduced gloss. As a result, the toner gloss becomes nonuniform (gloss nonuniformity). It is thus impossible to effectively heat the surface of a fixing roll that is the heated member, using the external heating rolls. This may in turn make it impossible to achieve a high productivity or vary the gloss of color images (gloss nonuniformity). Therefore, disadvantageously, high-quality color images are not obtained.

To solve these problems, it is possible to use the external heating rolls to provide a quantity of heat to the surface of the heated member the instant the transfer paper enters the fixing portion. However, in view of the deviation of timing of the abutment of the external heating rolls against the heated member and the deviation of timing of the entry of the transfer paper into the fixing portion, it is impossible to match the timing of entry of the transfer paper into the fixing portion with the timing of provision, by the external heating rolls, of a quantity of heat to the surface of the heated member. For example, it is assumed that an attempt is made to increase the productivity of a copier and that the transfer paper is conveyed at a speed of 300 mm/sec in order to achieve a productivity of 70 CPM. When the deviation of timing of the abutment of the external heating rolls against the heated member is 100 msec in view of the responsiveness of a motor or the like and the deviation of timing of the entry of the transfer paper into the fixing portion is 200 msec in view of conveying speed errors, the resulting timing deviation is about 300 msec. In terms of distance, this corresponds to a deviation of 90 mm.

SUMMARY OF THE INVENTION

Thus, the present invention has been made in order to solve the above problems. It is an object of the present invention to provide a fixing apparatus which can instantaneously adjust the quantity of heat provided by external heating members such as external heating rolls to the surface of a fixing member (heated member) such as heating fixing rolls and which can drastically increase productivity even if a recording material is cardboards, the fixing apparatus being capable of providing high-quality color images free from variations in gloss (gloss nonuniformity).

The present invention is a fixing apparatus characterized by the following configuration.

(1) A fixing apparatus comprising a first and second fixing rotating members that use nip portions to thermally fix a toner image on a recording material and a first and second heating members that abut against the first fixing rotating member to heat an outer surface of the first fixing rotating member, the apparatus being characterized in that when a fixing operation is started, the first heating member and the second heating member are sequentially abutted against the first fixing rotating member.

(2) The fixing apparatus in (1), characterized in that the recording material rushes into the nip portion before the first heating member increases the temperature of the first fixing rotating member by a predetermined value, and the second heating member is abutted against the first fixing rotating member before the recording material reduces the temperature of the first fixing rotating member by a predetermined value.

(3) A fixing apparatus comprising a first and second fixing rotating members that use nip portions to thermally fix a toner image on a recording material and a first and second heating members that abut against the first fixing rotating member to heat an outer surface of the first fixing rotating member, the apparatus being characterized in that when a fixing operation is started, pressures at which the first heating member and the second heating member abut against the first fixing rotating member are sequentially increased.

(4) The fixing apparatus in (3), characterized in that the recording material rushes into the nip portion before the first heating member increases the temperature of the first fixing rotating member by a predetermined value, and the abutting pressure of the second heating member is increased before the recording material reduces the temperature of the first fixing rotating member by a predetermined value.

That is, in a fixing apparatus comprising a plurality of external heating members, the quantity of heat provided by the external heating members to the surface of the fixing rotating member can be adjusted by varying the times at which individual external heating members abut against the fixing rotating member or varying the pressures at which the individual external heating members abut against the fixing rotating member. It is thus possible to increase the heat capacity of the external heating members. Therefore, a fixing apparatus can be provided which can drastically increase productivity even if recording materials are cardboards and which can provide high-quality color images free from variations in gloss.

DESCRIPTION OF THE PREFERRED EMBODIMENTS (First Embodiment)

(1) Example of Image Forming Apparatus

Figure 1:
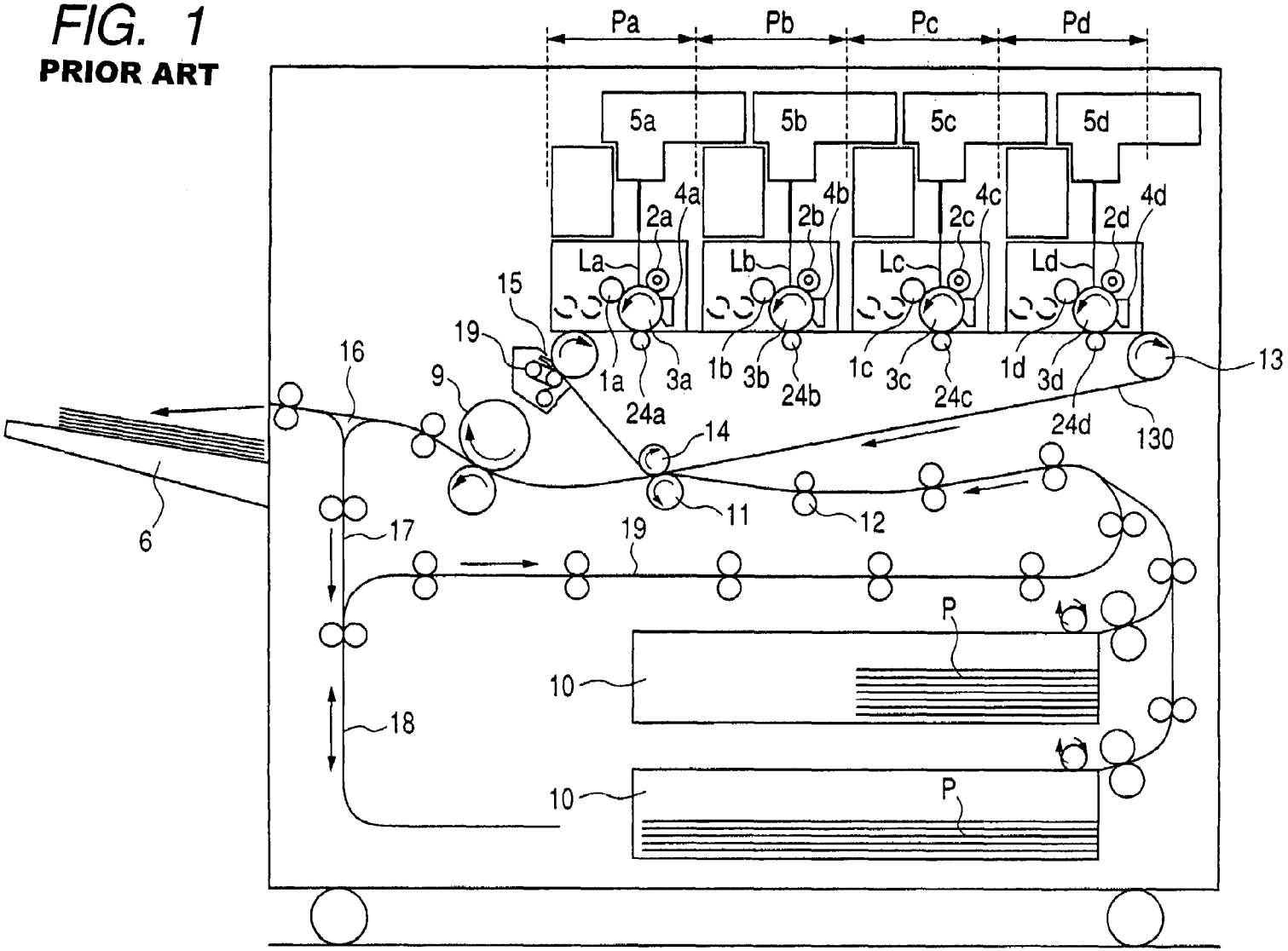
FIG. 1 PRIOR ART
FIG. 1 is a diagram showing the general configuration of an example of an image forming apparatus.

FIG. 1 is a schematic diagram showing the general configuration of an example of an image forming apparatus. The image forming apparatus according to the present example is a tandem type color laser printer using a transferring electrophotography process.

The image forming apparatus includes a first, second, third, and fourth image forming portions Pa, Pb, Pc and Pd. The image forming apparatus executes a latent image forming, developing, and transferring processes to form toner images in different colors.

The image forming portions Pa, Pb, Pc and Pd comprise exclusive image bearing members, in the present example, electrophotographic photosensitive drums 3*a*, 3*b*, 3*c* and 3*d*, respectively. Toner images in different colors are formed on the respective photosensitive drums 3*a*, 3*b*, 3*c* and 3*d*. An intermediate transfer member (intermediate transfer belt) 130 is installed adjacent to the photosensitive drums 3*a*, 3*b*, 3*c* and 3*d*. The toner images in different colors formed on the respective photosensitive drums 3*a*, 3*b*, 3*c* and 3*d* are primarily transferred to the intermediate transfer member 130. A secondary transfer member transfers the toner images to a recording material P. Moreover, a fixing apparatus 9 heats and presses the recording material P on which the toner images have been transferred, to fix the toner images. The recording material P is then discharged to a sheet discharging tray 6 located outside the image forming apparatus, as a recording image formed material.

The photosensitive drums 3*a*, 3*b*, 3*c* and 3*d* have drum chargers 2*a*, 2*b*, 2*c* and 2*d*, developing devices 1*a*, 1*b*, 1*c* and 1*d*, primary transfer charging devices 24*a*, 24*b*, 24*c* and 24*d*, and cleaners 4*a*, 4*b*, 4*c* and 4*d*, respectively, around their outer peripheries. Moreover, laser scanners 5*a*, 5*b*, 5*c* and 5*d* are installed above the image forming apparatus.

The photosensitive drums 3*a*, 3*b*, 3*c* and 3*d* are rotationally driven counterclockwise as shown by an arrow to have their peripheral surfaces primarily charged by the drum chargers 2*a*, 2*b*, 2*c* and 2*d* uniformly to a predetermined polarity and potential. The laser scanners 5*a*, 5*b*, 5*c* and 5*d* output laser light to the uniformly charged surfaces of the photosensitive drums 3*a*, 3*b*, 3*c* and 3*d*, respectively. Scanning exposure is carried out using laser light modulated in accordance with an image signal to form latent images on the photosensitive drums 3*a*, 3*b*, 3*c* and 3*d* in accordance with the image signal. Specifically, light source apparatuses, polygon mirrors, and the like are installed in the laser scanners 5*a*, 5*b*, 5*c* and 5*d*. Latent images in accordance with the image signal are formed on the photosensitive drums 3*a*, 3*b*, 3*c* and 3*d* by rotating the polygon mirror to scan laser light emitted by the light source apparatus, using a reflecting mirror to polarize a luminous flux of the scanning light, and using an fθ lens to concentrate the luminous flux on a generating line of the photosensitive drum 3*a*, 3*b*, 3*c* or 3*d* for exposure L*a*, L*b*, L*c* and L*d*.

The developing devices 1*a*, 1*b*, 1*c* and 1*d* have been filled with a cyan, magenta, yellow, and black toners in a predetermined amount, respectively, as developers using a supplying apparatus (not shown). The developing devices 1*a*, 1*b*, 1*c* and 1*d* develop the latent images on the photosensitive drums 3*a*, 3*b*, 3*c* and 3*d*, respectively, to visualize the latent images as a cyan, magenta, yellow, and black toner images.

The intermediate transfer member 130 is extended between three parallel rollers 13 and 14 and 15. The intermediate transfer member 130 is rotationally driven clockwise as shown by an arrow at the same peripheral speed as that which the photosensitive drums 3*a*, 3*b*, 3*c* and 3*d* are driven.

A toner image of yellow, a first color, formed and borne on the pohotosensitive drum 3*a* of the first image forming portion Pa passes through a nip portion between the photosensitive drum 3*a* and the intermediaute transfer member 130. On this occasion, an electric field and pressure are formed by a primary transfer bias applied to the intermediate transfer member 130. The electric field and pressure then cause the toner image to be primarily transferred to an outer peripheral surface of the intermediate transfer member 130.

A toner image of magenta, a second color, a toner image of cyan, a third color, and a toner image of black, a fourth color, are sequentially transferred to the intermediate transfer member 130 so as to be superimposed on one another; the toner images are formed and borne on the photosensitive drums 3*b*, 3*c* and 3*d* of the second, third, and fourth image forming portions Pb, Pc and Pd. Thus, a synthesized color toner image corresponding to an intended color image is formed on the intermediate transfer member 130.

Reference numeral 11 denotes a secondary transfer roller which sandwiches the intermediate transfer member 130 between itself and the one 14 of the three rollers 13, 14 and 15, around which the intermediate transfer member 130 is extended. The secondary transfer member 11 thus comes into pressure contact with the intermediate transfer member 130 to form a secondary transfer nip portion between itself and the intermediate transfer member 130.

On the other hand, one recording material P is fed from a feeding cassette 10. The recording material is then caused to wait for a predetermined time at a registration roller 12 as recording material conveying means. Then, the recording material P starts to be conveyed using such a predetermined timing as allows the recording material P to be aligned with an image on the intermediate transfer member. The recording material then passes through a pre-transfer guide and is fed to the secondary transfer nip portion, the abutting nip between the intermediate transfer member 130 and the secondary transfer roller 11, using a predetermined timing. A bias power source then applies a secondary transfer bias to secondarily transfer the entire synthesized color toner image transferred to the intermediate transfer member 130 in a superimposable manner, to the recording material P at a time.

The secondary transfer nip portion transfers the synthesized color toner image to the recording material P. The recording material P is then separated from the intermediate transfer member 130 and sequentially introduced into the fixing apparatus 9. Then, the recording material P is heated and pressed to fix the toner image.

The photosensitive drums 3*a*, 3*b*, 3*c* and 3*d* on which the primary transfer has been executed have residual toner removed using cleaners 4*a*, 4*b*, 4*c* and 4*d*. The photosensitive drums 3*a*, 3*b*, 3*c* and 3*d* thus allow for the formation of the next latent image and subsequent operations.

Toner and other foreign matter remaining on the transfer belt 130 are wiped away by abutting a cleaning web (nonwoven cloth) 19 against a surface of the transfer belt 130.

If a double-side copy mode has been selected, a flapper 16 introduces the recording material P having an image formed on its first surface and exiting the fixing apparatus 9 into a sheet path 17 of a recirculatory conveying mechanism. The recording material P then enters a switchback sheet path 18. The recording material P is then withdrawn from the sheet path 18, conveyed, and guided to a re-conveying sheet path 19. The recording material P then passes through the sheet path 19, the registration roller 12, and the pre-transfer guide in this order. Then, a predetermined timing is used to reintroduce the recording material P into the secondary transfer nip portion, which is the abutting nip between the intermediate transfer member 130 and the secondary transfer roller 11, with a front surface and a rear surface of the material reversed. Thus, the toner image on the intermediate transfer member 130 is secondarily transferred to a second surface of the recording material P. The recording material P on which the toner image has been secondarily transferred by the secondary transfer nip portion to the second surface is separated from the intermediate transfer member 130 and reintroduced into the fixing apparatus 9. Then, the recording material P has its toner image fixed and is then discharged to the sheet discharging tray 6, located outside the image forming apparatus, as a double-side copy.

As described above, in the color image, multiple color toners form two to four layers. Consequently, toners for an electrophotographic image forming apparatus capable of forming color images have characteristics different from those of toners for a monochromatic apparatus.

Specifically, the former toners are requested to be appropriately melted and mixed and thus have a lower softening point and a lower melting viscosity. In other words, these are sharp melt toners. The use of such sharp melt toners provides color copies with a wide color reproduction range.

The sharp melt toners are manufactured by melting, kneading, crushing, and classifying toner forming materials such as a binding resin, for example, a polyester resin or a styrene-acrylester resin, a coloring agent (a dye or sublime dye), and a charge control agent.

(2) Image Heating Fixing Apparatus 9

Figure 2:
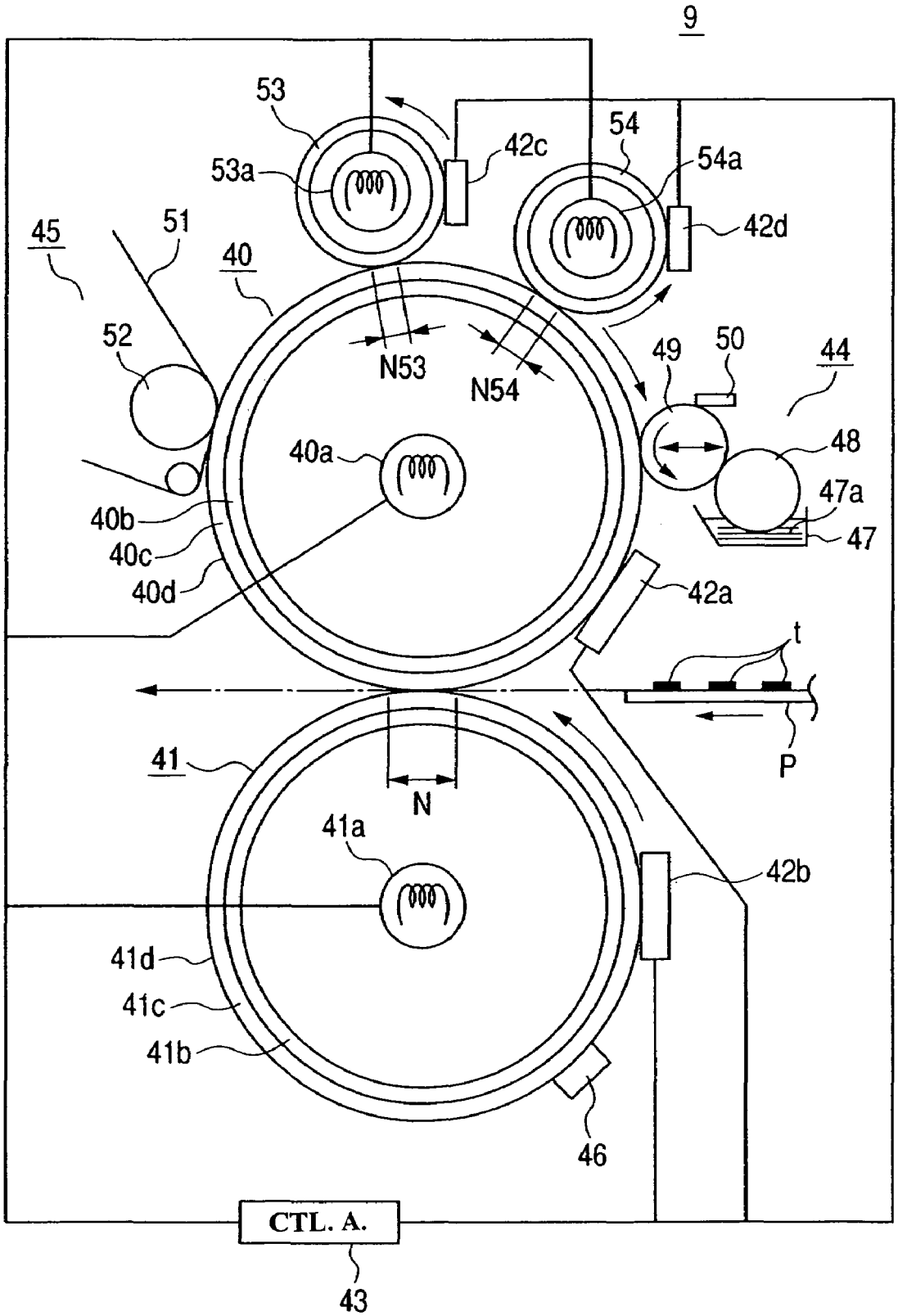
FIG. 2 PRIOR ART
FIG. 2 is a diagram showing the general configuration of a fixing apparatus.

Now, the configuration of the image heating fixing apparatus 9 will be described in detail with reference to FIG. 2. The image heating fixing apparatus 9 is configured as a pair of fixing members including a fixing roller 40 serving as a first fixing member (fixing rotating member) and internally having a halogen heater 40*a* that is heating means and a pressing roller 41 serving as a second fixing member (pressing rotating member) and internally having a halogen heater 41*a* that is heating means; the fixing roller 40 and the pressing roller 41 are arranged so that a pressing mechanism (not shown) can rotate them while keeping them in pressure contact with each other at a total pressure of about 784 N (about 80 kg). Reference character N denotes a fixing nip portion formed by the pressure contact between the fixing roller 40 and the pressing roller 41. The fixing roller 40 and the pressing roller 41 are rotationally driven by a driving system (not shown) in the direction of an arrow.

Thermistors 42*a* and 42*b* that are temperature sensing means abut against the fixing roller 40 and pressing roller 41, respectively. The thermistors 42*a* and 42*b* sense the temperatures of the fixing roller 40 and pressing roller 41. On the basis of this sensing information, a control apparatus 43 (CTL. A) controls the halogen heaters 40*a* and 41*a* so as to maintain the temperatures of both fixing roller 40 and pressing roller 41 at about 165° C. An unfixed image t is heated and pressed upon passing through the fixing nip portion N between the fixing roller 40 and the pressing roller 41; the unfixed image has been formed using a developer such as a sharp melt toner and transferred to the recording material P.

The sharp melt color toners formed on the recording material P has a high affinity and is easily offset on the fixing roller 40. Thus, the color toners must exhibit a sufficient releasability for a long time. Thus, an oil applying apparatus 44 and a cleaning apparatus 45 are provided near an outer periphery of the fixing roller 40; the oil applying apparatus 44 serves as a mold releasing agent and the cleaning apparatus 45 which includes belt 51 and roller 52 removes oil and dirt from the fixing roller 40. A cleaning blade 46 is provided near an outer periphery of the pressing roller 41 to remove oil and dirt from the pressing roller 41, thereby further enhancing releasability.

The oil applying apparatus 44 passes dimethyl silicone oil 47*a* (KF 96, 300 cs manufactured by Shin-Etsu Chemical Co., Ltd.) from an oil pan 47 through an oil pumping roller 48 and an oil applying roller 49. The oil applying apparatus 44 then applies the oil 47*a* to an outer peripheral surface of the fixing roller 40 while using an oil application amount adjusting blade 50 to regulate the amount of oil applied.

The oil applying roller 49 can contact with and separate from the fixing roller 40. The oil applying roller 49 applies the oil to the recording material P over a fixing roller operation surface length from a position 5 mm from the leading end of the recording material P to a position 5 mm from the trailing end of the recording material P.

The fixing roller 40 has an HTV (high temperature vulcanization type) silicone rubber layer 40*c* provided around an outer periphery of an aluminum core metal 40*b* as an elastic layer, and an RTV (room temperature vulcanization type) silicone rubber layer 40*d* provided around an outer periphery of the HTV silicone rubber layer 40*c* as a heat-resistant elastic layer. The fixing roller 40 has a thickness of 3 mm and a diameter of 60 mm.

On the other hand, the pressing roller 41 has an HTV silicone rubber layer 41*c* of thickness 1 mm which is provided around an outer periphery of an aluminum core metal 41*b* and which serves as an elastic layer and a fluorine resin layer 41*d* provided around an outer periphery of the HTV silicone rubber layer 41*c*. The pressing roller 41 has a diameter of 60 mm.

A combination of the fixing roller 40 and pressing roller 41 configured as described above allows the sharp melt toners to be more appropriately released.

Further, in recent years, color copiers have prevailed. These color copiers must operate as fast and conveniently as monochromatic copiers. Specifically, the color copiers must meet various needs such as automatic double-side copy, the use of paper ranging from postcards to large-sized sheets and the use of thin paper and cardboards as well as OHP films and pack print films.

Thus, for the purpose of fixing images to both sides of a sheet, RTV or LTV (low temperature vulcanization type) silicone rubber, which allows the toners to be appropriately released, is used in a front layer not only of the fixing roller 40 but also of the pressing roller 41. At the same time, the size of the fixing nip portion N is increased in order to increase the diameters of the rollers (for example, 80 mm) to accomplish quick color fixation. Moreover, for the purpose of allowing the use of cardboards or the like, the fixing temperature is increased to enable images to be more appropriately fixed.

Further, both front and lower silicone rubbers have a high affinity for the silicone oil; the front silicone rubber is used to maintain releasability and the lower silicone rubber is used to form such a fixing nip portion N as wraps up the silicone rubber in the front layer used to maintain releasability as well as the sharp melt toners. Accordingly, depending on durability, a large amount of silicone oil may infiltrate into the silicon rubber. In particular, the lowermost silicone rubber may contain a large amount of silicone oil and may be peeled off from the boundary surface of the core metal during heating. Thus, in copiers which are desired to provide a large number of copies at high speed, fluorine rubber is desirably stacked, as an oil resistant layer, between the lower and front silicone rubbers in both fixing roller 40 and pressing roller 41 in order to prevent the peel-off; the fluorine rubber does not absorb the silicone oil or allow the silicone oil to pass through.

(2-1) External Heating Member

Now, description will be given of the configuration of an external heating member which is characteristic of the present invention. As shown in FIG. 2, a first and second external heating rollers 53 and 54, which serve as external heating members are provided on an outer peripheral surface of the fixing roller 40 in parallel, that is, on an upstream and downstream sides, respectively, in a direction in which the fixing roller 40 rotates. The external heating rollers 53 and 54 can abut against and retract from the fixing roller 40. An abutting/retracting mechanism will be described later.

The external heating rollers 53 and 54 are intended to maintain the surface temperature of the fixing roller because thermal response from the fixing roller heater 40*a* is not quick enough to compensate for the quantity of heat absorbed by the recording material during fixation owing to the low thermal conductivity of the front rubber layer of the fixing roller. Further, for the purpose of enabling the image forming apparatus to operate at high speed, two external heating rollers are provided in order to increase the quantity of heat provided by the external heating rollers 53 and 54 to the surface of the fixing roller.

The external heating rollers 53 and 54 contain the halogen heaters 53*a* and 54*a*. At the outer peripheries of the external heating rollers 53 and 54, the metal surface is coated with metal such as aluminum, iron, or stainless steel which has a high thermal conductivity, or rubber or resin, which has a high releasability. The external heating rollers 53 and 54 are held at their opposite ends by heat insulating bushes having a high heat resistance.

The thermistors 42*a*, 42*b*, 42*c* and 42*d*, serving as temperature sensing means, are arranged in contact with the fixing roller 40, pressing roller 41, and first and second external heating rollers 53 and 54, respectively. The thermistors 42*a*, 42*b*, 42*c* and 42*d* sense the surface temperatures of the rollers 40, 41, 53 and 54. Then, during a fixing operation, on the basis of the temperature information, the control apparatus 43 controls power supplied to the halogen heaters 40*a*, 41*a*, 53*a* and 54*a* to adjust the temperatures of the rollers 40, 41, 53 and 54.

As an example of temperature adjustment, the first external heating roller 53 is set so that its temperature is higher than those of the fixing roller 40 and pressing roller 41, which constitute a fixing member pair. For example, the temperature of the external heating rollers 53 and 54 is set at 230° C. The temperature of the fixing roller 40 and pressing roller 41 is set at 165° C.

That is, the control apparatus 43 has first control means for controlling the temperature of fixing roller 40 and pressing roller 41, which are the fixing members, and second control means for controlling the temperature of the first external heating roller 53 and second external heating roller 54, which are the plurality of external heating members. A target temperature for the first external heating roller 53 and second external heating roller 54 to be achieved by the second control means is higher than that for the fixing roller 40 and pressing roller 41 to be achieved by the first control means.

When the temperature of the external heating rollers 53 and 54 is kept higher than that of the fixing roller 40, the fixing member, heat from the external heating rollers 53 and 54 is properly supplied to the fixing roller 40 in response to a decrease in the surface temperature of the fixing roller 40 caused by the recording material (heat sense accuracy). Accordingly, the temperature of the external heating rollers 53 and 54 is set higher than that of the fixing roller 40 and pressing roller 41 by 75° C.

(2-2) Pressing Arrangement for External Heating Members

Now, description will be given of a pressing mechanism serving as means for pressing the external heating members 53 and 54 against the fixing roller 40.

Figure 3A:
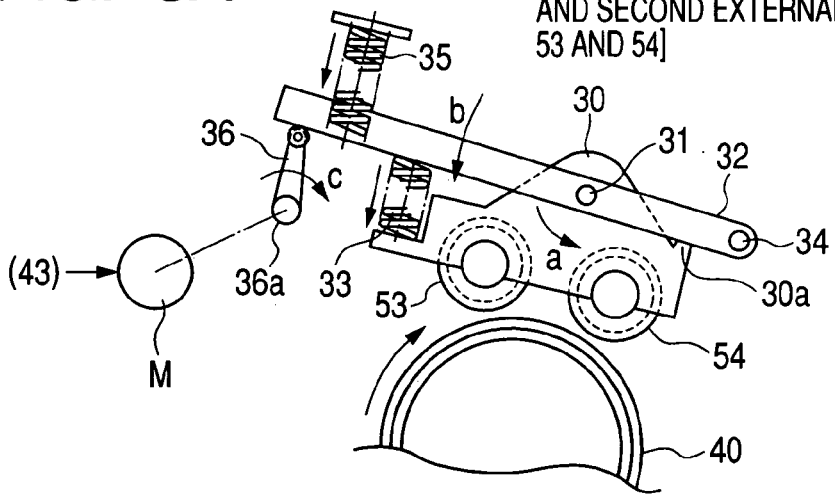
FIGS. 3A, 3B and 3C are diagrams illustrating a pressing arrangement and a detachably mountable arrangement for an external heating member of a fixing apparatus according to First Embodiment.
Figure 3B:
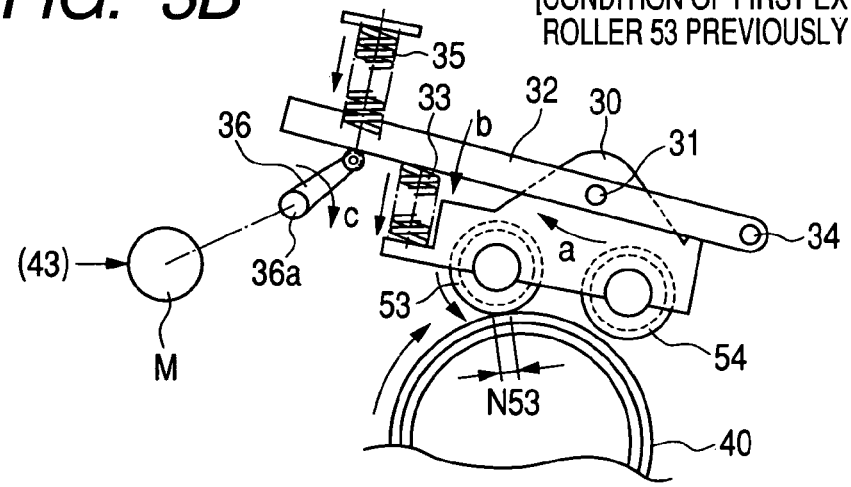
Figure 3C:
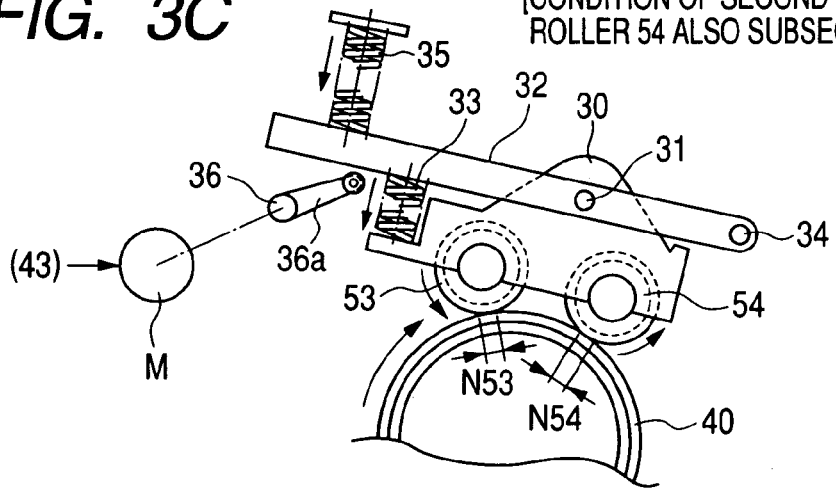

As shown in FIGS. 3A to 3C, the first and second external heating rollers 53 and 54 have their opposite ends rotatably supported by an external heating support frame 30 via a heat insulating bush and a bearing (not shown). The external heating support frame 30 has its front and back ends turnably supported by external heating pressing arms 32 via a support shaft 31. Further, the external heating support frame 30 is urged by a spring 33 to turn around the support shaft 31 in the direction of an arrow a. While the external heating rollers 53 and 54 are separate from the fixing roller 40 as shown in FIG. 3A, an abutting portion 30*a* of the external heating support frame 30 abuts against the external heating pressing arm 32. The external heating pressing arm 32 is turnable around a support shaft 34 with respect to a fixing device frame (not shown). An external heating pressing spring 35 is provided at a free end of the external heating pressing arm 32. The external heating pressing arm 32 is thus urged to turn around the support shaft 34 in the direction of an arrow b.

When the first and second external heating rollers 53 and 54 abut against the fixing roller 40 as shown in FIG. 3C, the external heating pressing spring 35 and the spring 33 press the external heating rollers 53 and 54 against the fixing roller 40. The external heating rollers 53 and 54 are brought into pressure contact with the fixing roller 40 at a total pressure of about 392 N (about 40 kg). The external heating rollers 53 and 54 rotate in unison with the fixing roller 40. The abutting nips (contact lengths) N53 and N54 between the external heating rollers 53 and 54 and the fixing roller 40 are about 5 mm. Accordingly, the two rollers 53 and 54 as a whole provide a 10-mm nip.

(2-3) Detachably Mountable Arrangement for External Heating Members

Now, with reference to FIGS. 3A to 3C, description will be given of a detachably mountable mechanism serving as means for detachably mounting the first and second external heating members 53 and 54. As described above, the external heating pressing arm 32 is turnable around the support shaft 34, with the tip of a pressure releasing arm 36 abutting against the free end of the external heating arm 32. The pressure releasing arm 36 is turnable around the center of a turning shaft 36*a*.

When the first and second external heating rollers 53 and 54 are pressed against the fixing roller 40 as shown in FIG. 3C, the pressure releasing arm 36 is separate from the external heating pressing arm 32. When the first and second external heating rollers 53 and 54 are separated from the fixing roller 40, the pressure releasing arm 36 is rotated to push the pressing arm 32 upward as shown in FIG. 3A. The pressure releasing arm 36 is turned by turning means M controlled by the control apparatus 43 (FIG. 2).

The turning means M is composed of a spring clutch, a motor, or the like according to the conventional art.

Now, with reference to FIGS. 3A to 3C, description will be given of operations required to press the external heating rollers 53 and 54 separate from the fixing roller 40 against it.

FIG. 3A shows a state in which the first and second external heating rollers 53 and 54 are separate from the fixing roller 40, that is, a standby state (standby for image formation). In this state, when an image formation start signal (if the image forming apparatus is a copier, the signal is generated by depressing a start button in a liquid crystal operation portion or the like. If the image forming apparatus is used as a printer connected to an external device such as a personal computer via a network, the signal is generated by a print instruction from the external device) is input to the image forming apparatus, various image forming devices in the image forming apparatus start image formation preparing operations. The fixing apparatus also starts a fixation preparing operation.

Then, a fixing preparation operation is started. Once the temperatures of the fixing roller, pressing roller, and two external heating rollers reach a value appropriate for starting fixations a fixing operation is started. In the present example, the fixing operation is started on the basis of the time at which a fourth image forming portion starts image exposure of the photosensitive member. Specifically, the detachably mountable mechanism starts operation a predetermined time after the start of exposure of the photosensitive member by the fourth image forming portion.

Further, also on the basis of the image exposure start timing, the intermediate transfer member conveys the recording material to the secondary transfer portion, that is, the registration roller starts conveyance.

That is, the pressure releasing arm 36 is turned in the direction of an arrow c. The external heating pressing arm 32 is turned in the direction of the arrow b. The external heating support frame 30, that is, the first and second external heating rollers 53 and 54, start moving toward the fixing roller 40.

Then, as shown in FIG. 3B, first, the first external heating roller 53 abuts against the fixing roller 40 to transfer heat from the first external heating roller 53 to the fixing roller 40. In this state, the spring 33 presses the first external heating roller 53 against the fixing roller 40.

Further, when the pressure releasing arm 36 turns in the direction of the arrow c, the external heating support frame 30 turns around the turning shaft 31 in the direction of an arrow d. As shown in FIG. 3C, the second external heating roller 54 is also brought into pressure contact with the fixing roller 40 to transfer heat from the second external heating roller 54 to the fixing roller 40. The pressing operation is thus finished. In the state shown in FIG. 3C, the external heating pressing spring 35 and the spring 33 press the first and second external heating rollers 53 and 54 against the fixing roller 40.

That is, the pressure releasing arm 36 is turned in the direction of the arrow c. Accordingly, first, the first external heating roller 53 abuts against the fixing roller 40. A predetermined time later, the second external heating roller 54 abuts against the fixing roller 40.

When a fixing operation is started, a control circuit portion 34 uses turning means M to turn the pressure releasing arm 36 in the direction of the arrow c to perform the operations shown in FIGS. 3A, 3B and 3C in this order.

This causes the first and second external heating rollers 53 and 54 to sequentially abut against the fixing roller 40.

When a fixing operation is ended, the control circuit portion 34 uses turning means M to turn the pressure releasing arm 36 in the direction opposite to that of the arrow c to reversely perform the operations shown in FIGS. 3A, 3B and 3C. The control circuit portion 34 thus recovers the initial state shown in FIG. 3A, that is, separates both first and second external heating rollers 53 and 54 from the fixing roller 40. The control circuit portion 34 then maintains this state until the next fixing operation is started.

(2-4) Comparative Experiments (1) An external heating member abutment control means is provided which controls the process so that the first and second external heating members 53 and 54 simultaneously abut against the fixing roller 40 to cause the leading end of the recording material P to advance into the fixing nip portion N while the temperature of the nip portion N is rising.

(2) There are no external heating rollers.

(3) The first external heating roller 53 first abuts against the fixing roller 40, and a predetermined time later, the second external heating roller 54 abuts against the fixing roller to press it. That is, the external heating roller 53 is abutted against the fixing roller 40 immediately before the recording material reaches the nip portion.

Experiments were made to compare variations in the temperature of the surface of the fixing roller 40 in the cases (1), (2) and (3). The results of the experiments are shown in FIGS. 5A to 5C.

Figure 5A:
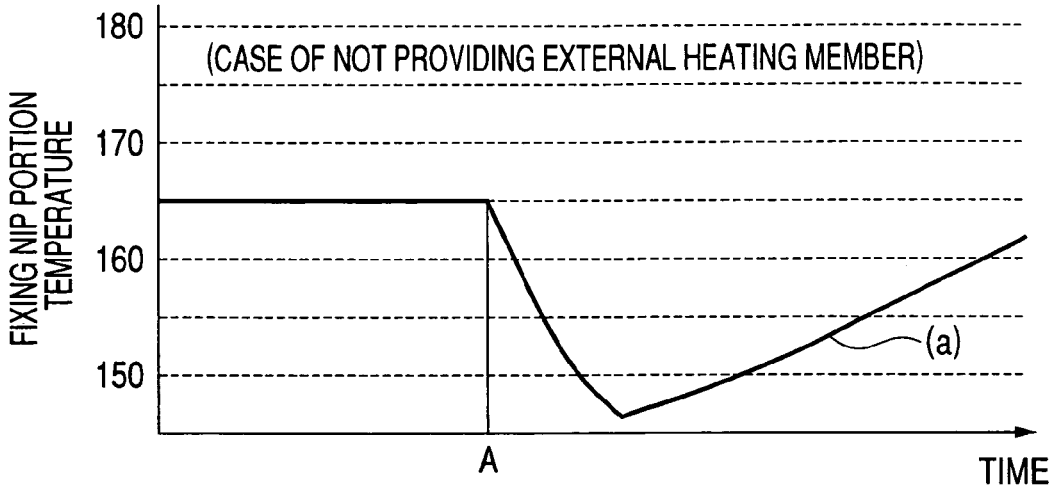
FIGS. 5A, 5B and 5C are graphs showing a transition in the temperature of the fixing roller.
Figure 5B:
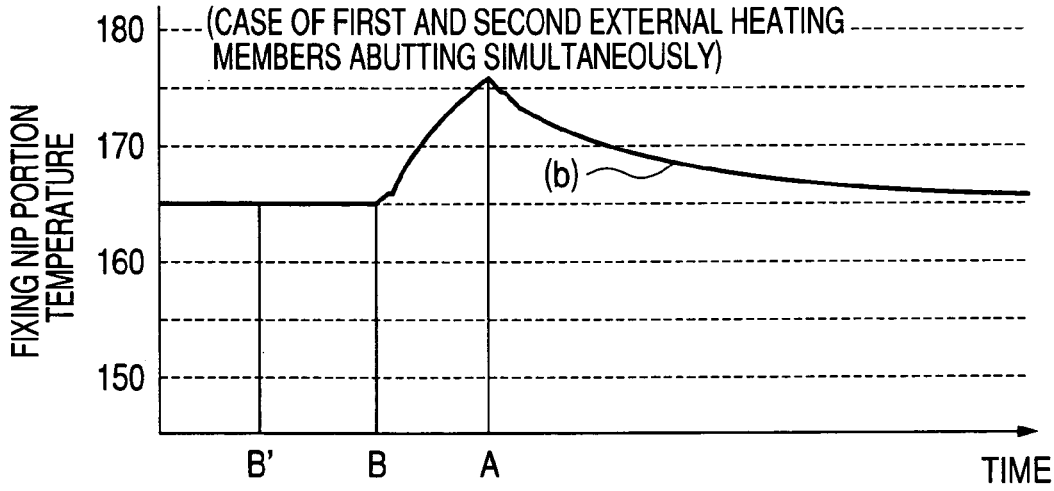
Figure 5C:
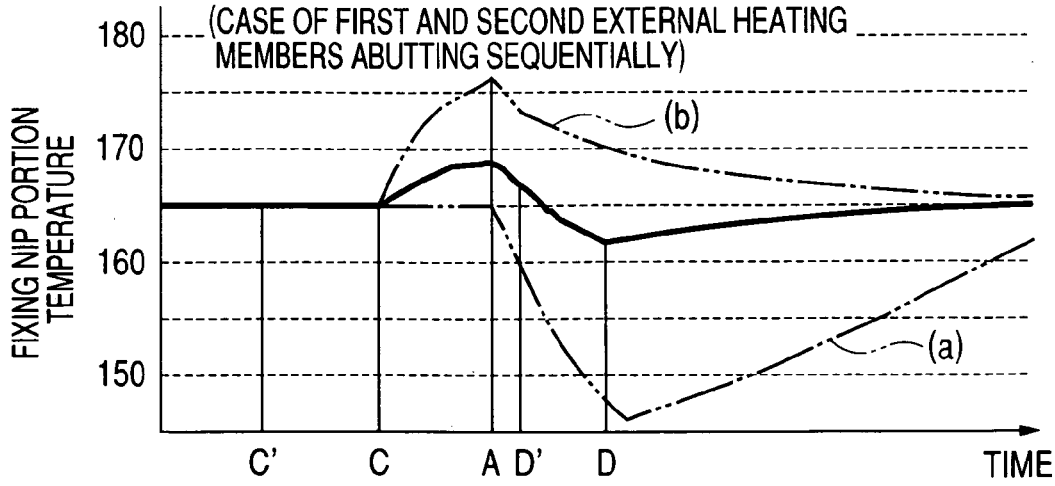

In FIGS. 5A to 5C, the axis of abscissa indicates time (seconds), and the axis of ordinate indicates the temperature of the fixing nip portion (the temperature of the surface of the fixing roller 40 at the fixing nip portion N) (° C).

The first and second external heating rollers 53 and 54 were hollow aluminum bars of outer diameter 30 mm and thickness 3 mm. Each of the nip portions N53 and N54 formed by the fixing roller 40 and external heating rollers 53 and 54 had a width of 4 mm in the rotating direction.

The experiments were made under the following conditions. The halogen heater 40*a* of the fixing roller 40 was configured to operate at 1,200 W. The halogen heaters 53*a* and 54*a* of the external heating rollers 53 and 54 were configured to operate at 500 W. The recording material P was conveyed at a speed of 300 mm/sec and was 250 g/m$^2$. The wattage of the heater of the external heating roller was set so that the temperature of surface of the fixing roller was maintained even if recording materials of 250 g/m$^2$ were continuously transported at 300 mm/sec.

In FIGS. 5A to 5C, at a point A, the recording material P rushes into the fixing nip portion N. At a point B', the first and second external heating rollers 53 and 54 simultaneously start to abut against the fixing roller 40. At a point B, the point of the fixing roller 40 against which the external heating rollers 53 and 54 simultaneously started to abut reaches the fixing nip portion N for the first time. At a point C', the first external heating roller 53 starts to abut against the fixing roller 40. At a point C, the point of the fixing roller 40 against which the first external heating roller 53 started to abut reaches the fixing nip portion N for the first time. At a point D', the second external heating roller 54 starts to abut against the fixing roller 40. At a point D, the point of the fixing roller 40 against which the second external heating roller 54 started to abut reaches the fixing nip portion N for the first time.

FIG. 5A shows the case (2) in which the external heating members 53 and 54 are not provided. In this case, when the recording material P rushes into the fixing nip portion N, it absorbs heat to lower the surface temperature of the fixing roller 40. When the fixing heater starts thermal response, the surface temperature of the fixing roller 40 rises and returns to the initial value. The temperature of the fixing roller decreases by as much as about 20° C. This may not only degrade gloss but also cause a low-temperature offset, resulting in inappropriate fixation.

Figure 4:
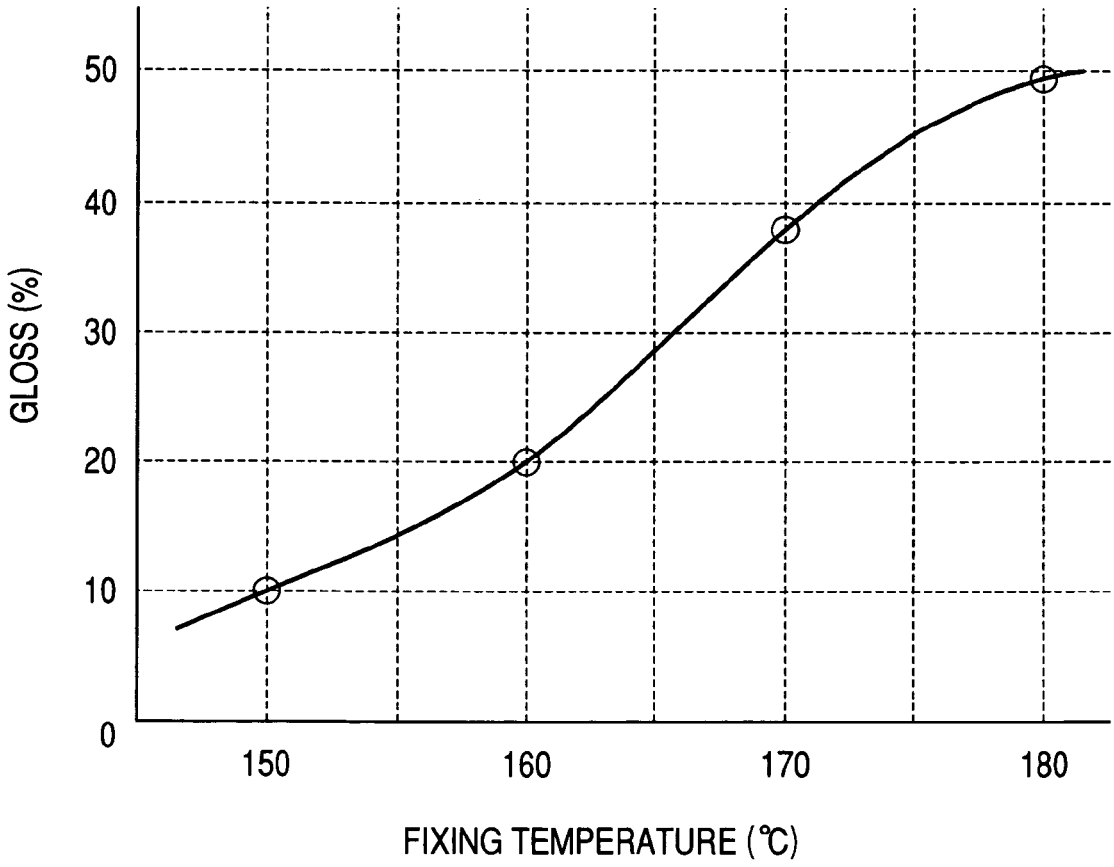
FIG. 4 is a graph showing the relationship between the temperature of a fixing roller and gloss.

FIG. 4 is a graph showing a variation in the gloss of the recording material (roughness of the image surface) vs. the temperature of the fixing nip portion N of the image heating fixing apparatus 9.

In the above experiments, even when inappropriate fixation did not occur, the gloss decreased by 30 to 15%. Thus, the gloss varied significantly, precluding the fixed recording material from having a high image quality. Therefore, in order to form a high-quality image, it is preferable to keep the variation in gloss at most 20%.

FIG. 5B shows the case (1) in which the first and second external heating rollers 53 and 54 simultaneously abut against the fixing roller 40 and an area that the two external heating rollers 53 and 54 have started to heat (start to abut) passes the fixing nip portion N for the first time, before the leading end of the recording material P in the conveying direction reaches the fixing nip portion N. In this case, the first and second external heating rollers 53 and 54 have their temperatures adjusted to 230° C., and both start supplying heat to the fixing roller 40 before the recording material P reaches the fixing nip portion N. Consequently, the temperature of the fixing roller 40 starts to rise at the point B where the point against which the external heating rollers 53 and 54 abutted reaches the fixing nip portion N for the first time. The temperature of the fixing roller 40 continuously rises until the recording material P reaches the fixing nip portion N at the point A.

With this configuration, the temperature of the fixing roller 40 increased by nearly 15° C. Thus, the gloss varied by about 15%. The leading end of the recording material P in the conveying direction had an increased gloss. That is, with this configuration, there was a large difference in gloss between the leading end and trailing end of the first recording material in the conveying direction. The resulting image thus had a low image quality.

FIG. 5C shows the case in which the first external heating member 53 first abuts against the fixing roller 40, and a predetermined time later, the second external heating member 54 abuts against the fixing roller 40 according to the present invention, as described in (3). That is, the timing of conveyance of the recording material is controlled so that the first and second external heating members 53 and 54 sequentially abut against the fixing roller 40 to allow the leading end of the recording material to reach the fixing nip portion N while the temperature of the fixing nip portion N of the fixing roller 40 is rising (between C and D).

With this configuration, the first external heating roller 53 starts to supply heat to the fixing roller 40 before the recording material reaches the fixing nip portion N. The temperature of the fixing roller starts to rise at the point C at which the point of the fixing roller 40 against which the first external heating roller 53 started to abut reaches the fixing nip portion N for the first time. Then, the temperature of the fixing roller 40 continuously rises until the recording material P reaches the fixing nip portion N at the point A.

However, compared to FIG. 5B, showing that the first and second external heating members 53 and 54 simultaneously abut against and press the fixing roller 40, in the experiments, the temperature of the fixing roller 40 increased by a reduced amount when the recording material P reached the fixing nip portion N. The increase in the temperature of the fixing roller 40 was maintained at most 4° C. to prevent an increase in the gloss of the recording material P at its leading and trailing ends in the conveying direction. As a result, a high-quality image was obtained.

That is, when the leading end of the recording material P reaches the fixing nip portion N, since the first external heating roller 53 provides only a small quantity of heat to the fixing roller 40, the recording material P absorbs heat to reduce the surface temperature of the fixing roller 40. After the point against which the second external heating roller 54 abutted has passed by a point D at which it reaches the fixing nip portion N for the first time, the first and second external heating rollers 53 and 54 provide a sufficient quantity of heat to the fixing roller 40. Thus, the temperature of the fixing roller 40 returns gradually to the desired adjusted temperature (in the present example, 165° C.). That is, the decrease in the temperature of the fixing roller 40 was reduced to about 3° C. compared to the fixing roller temperature of 165° C., with a high image productivity maintained in the formation of images on a plurality of recording materials. This indicates that the present embodiment can significantly suppress the decrease in the surface temperature of the fixing roller.

As described above, the use of the external heating member abutment control means (in FIG. 5C) according to the present embodiment enabled the variation in the temperature of the fixing roller 40 to be maintained at most about 7° C. The variation in gloss was reduced to about 8%. This indicates that the present embodiment can accomplish a high image quality and a high productivity.

In the present example, owing to the high image forming speed (fixing speed), the two rollers 53 and 54 are used as external heating members to compensate for the decrease in the temperature of the fixing roller 40 caused by the recording material or toners. This makes it possible to deal with a continuous image forming job in which a plurality of recording materials are continuously passed through the nip portion and thus fixed.

Moreover, as described above, since the external heating members 53 and 54 compensate for the decrease in the temperature of the fixing roller 40, their adjusted temperature is set higher than that of the fixing roller 40. If a long time passes after the external heating members have abutted against the fixing roller and before the recording material passes through the fixing nip portion, the surface temperature of the fixing roller 40 becomes too high. This may result in inappropriate fixation.

Thus, preferably, the process is controlled so that the leading end of the recording material rushes into the fixing nip portion within a predetermined time after the first external heating roller 53 has abutted against the fixing roller 40, that is, within the time required by the external heating roller 53 to increase the adjusted surface temperature (165° C.) of the fixing roller 40 (at the nip portion) by a predetermined value, specifically 10° C.

The increase in temperature by 10° C. corresponds to a time required to deal with a gloss nonuniformity. Thus, of course, the present invention is not limited to this value, and appropriate values may be used for individual image forming apparatuses.

Preferably, the second external heating roller 54 starts to abut against the fixing roller 40 within the predetermined time after the leading end of the recording material rushes into the fixing nip portion N, that is, within the time required for the adjusted surface temperature of the fixing roller 40 to decrease by the predetermined value, specifically 10° C.

Similarly, the decrease in temperature by 10° C. corresponds to a time required to deal with a gloss nonuniformity. Thus, of course, the present invention is not limited to this value, and appropriate values may be used for individual image forming apparatuses.

In the present example, the abutting and retracting operations are performed in association with the timing of conveyance of the recording material P (the timing of advancement of the recording material into the fixing nip portion between the fixing roller 40 and pressing roller 41); in these operations, the first and second external heating rollers 53 and 54, external heating members, abut against and retract from the fixing roller 40, a fixing member pair. For this purpose, the time at which the first and second external heating rollers 53 and 54 start to abut against the fixing roller 40 is controlled using, as a trigger (a reference timing), the time at which a fourth image forming portion (image forming station) Pd located most downstream starts to form an image (the timing of start of exposure of the photosensitive member).

Further, once, in a continuous image forming job for a plurality of recording materials, a fixing process has been executed on the last recording material, the first and second external heating rollers 53 and 54 immediately retract from the fixing roller 40.

In the above example, the external heating rollers 53 and 54 are used as external heating members. However, instead of the rollers, the external heating members may be belt-like components composed of resin, rubber, metal, or the like and which rotate in unison with the fixing roller 40.

Further, in the above description, the external heating rollers 53 and 54 as external heating members are configured so that they can abut against and retract from the fixing roller 40 as a fixing member pair. However, the external heating rollers 53 and 54 may be configured so that they can abut against and retract from the pressing roller 41 as a fixing member pair.

Furthermore, the fixing member pair is composed of two rollers including the fixing roller 40 and the pressing roller 41. However, the fixing member pair may be composed of belt-like components instead of the rollers.

(Second Embodiment)

Second Embodiment will be described with reference to FIGS. 6A and 6B. The present embodiment is a fixing apparatus configured so as to sequentially increase the pressure at which the first and second external heating rollers 53 and 54 abut against the fixing roller 40 when a fixing operation is started.

The pressing arrangement and detachably mountable arrangement for the external heating members according to the present embodiment are the same as those shown in FIGS. 3A to 3C for First Embodiment except that they do not have the spring 33.

Figure 6A:
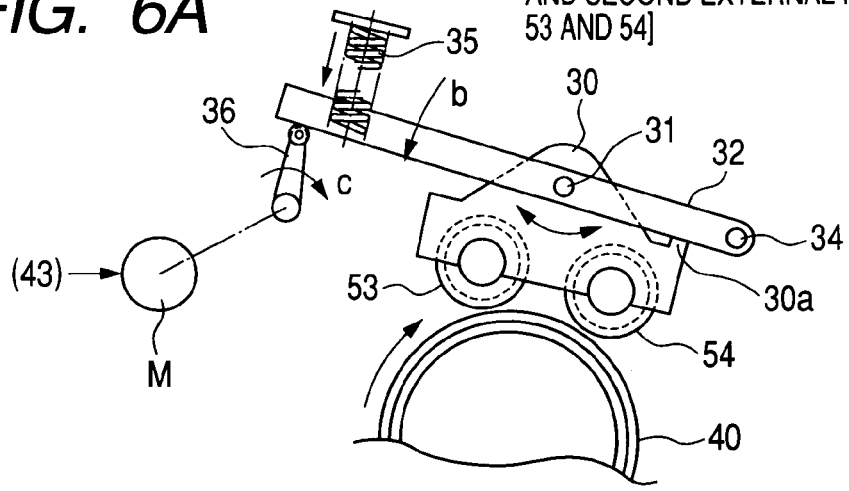
FIGS. 6A, 6B and 6C are diagrams illustrating a pressing arrangement and a detachably mountable arrangement for an external heating member of a fixing apparatus according to Second Embodiment.

FIG. 6A shows that the first and second external heating rollers 53 and 54 are separate from the fixing roller 40. In this state, the pressure releasing arm 36 is turned in the direction of the arrow c to turn the external heating pressing arm 32 in the direction of an arrow b. Consequently, the external heating support frame 30, that is, the first and second external heating rollers 53 and 54, start to move toward the fixing roller 40.

In the present embodiment, the first and second external heating rollers 53 and 54 almost simultaneously abut against the fixing roller 40. However, the abutting pressure of the first external heating roller 53 is higher than that of the second external heating roller 54. Moreover, as the pressure releasing arm 36 is turned in the direction of the arrow c, the pressing force of the spring 35 sequentially increases the abutting pressures of the first and second external heating rollers 53 and 54 as shown in FIG. 6B. Then, the abutting pressures are maximized when the pressure releasing arm 36 is separated from the external heating pressing arm 32 as shown in FIG. 6C. Thus, the abutting pressure of the first external heating roller 53 becomes almost the same as that of the second external heating roller 54.

Figure 6B:
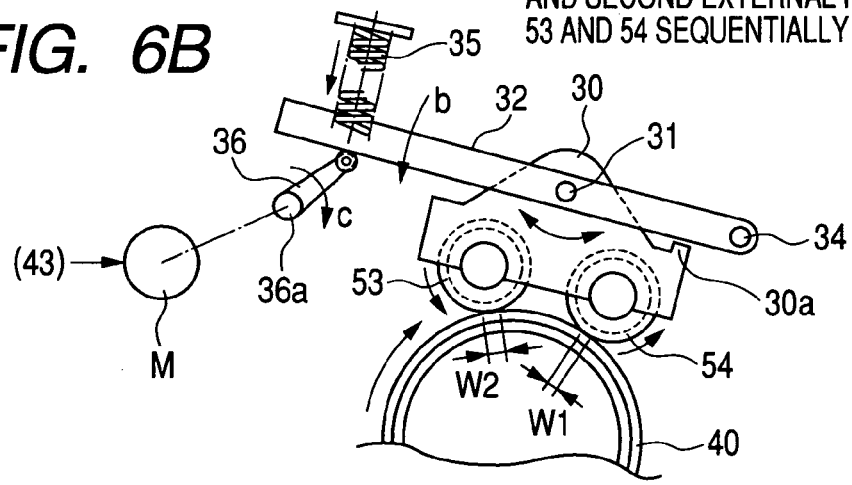
Figure 6C:
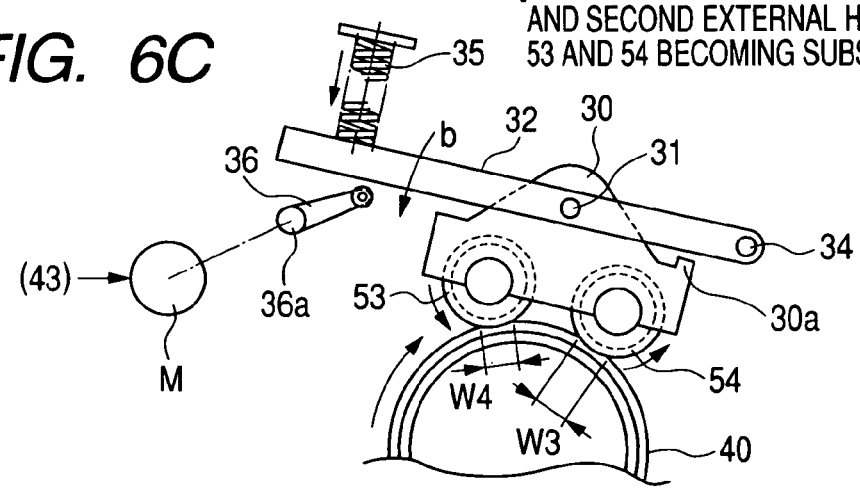

When a fixing operation is started, the control circuit portion 34 uses the turning means M to turn the pressure releasing arm 36 in the direction of the arrow c to perform the operations shown in FIGS. 6A, 6B and 6C in this order. Accordingly, the control circuit portion 34 sequentially increases the pressures at which the first and second external heating rollers 53 and 54 abut against the fixing roller 40 to cause them to abut against the fixing roller 40.

When the fixing operation is ended, the control circuit portion 34 uses the turning means M to turn the pressure releasing arm 36 in the direction opposite to that of the arrow c to reversely perform the operations shown in FIGS. 6A, 6B and 6C. Accordingly, the control circuit portion 34 recovers the initial state shown in FIG. 6A, that is, separates both first and second external heating rollers 53 and 54 from the fixing roller 40. The control circuit portion 34 then maintains this state until the next fixing operation is started.

In Second Embodiment, described above, the pressure releasing arm is maintained as shown in FIG. 6B to control the pressing forces of the external heating rollers and thus the nip lengths of the external heating rollers so as to obtain the effects similar to those of First Embodiment.

That is, when the total nip lengths of the external heating rollers 53 and 54 in FIGS. 6B and 6C are defined as "W1+W2" and "W3+W4," respectively, the relationship "W1+W2"<"W3+W4" is established. The nip length "W1+W2" depends on the fixing conditions. However, desirably, "W1+W2"="W3 +W4"/2 similarly to First Embodiment.

The above configuration makes it possible to provide a fixing apparatus which can drastically increase the productivity for cardboards similarly to First Embodiment and which can provide high-quality color images free from variations in gloss (gloss nonuniformity).

Thus, the fixing apparatus according to the present invention includes an image heating apparatus that temporarily fix an unfixed image and an image heating apparatus that reheats a print medium bearing an image to modify surface properties such as gloss.

This application claims priority from Japanese Patent Application No. 2004-095868 filed on Mar. 29, 2004, which is hereby incorporated by reference herein.

What is claimed is:

1. A fixing apparatus comprising:

first and second fixing rotating members that fix a toner image on a recording material at a nip portion formed therebetween; and first and second heating members that heat an outer surface of said first fixing rotating member from a exterior of said first fixing rotating member; and control means that controls heating operations of said first and second heating members so that the heating operation of said first heating member is started before a first recording material enters the nip portion and the heating operation of said second heating member is started while the first recording material passes through said nip portion.

2. The fixing apparatus according to claim 1, wherein said control means controls abutting operations of said first and second heating members to heat the outer surface of said first fixing rotating member so that the abutting operation of said first heating member is started before the first recording material enters the nip portion and the abutting operation of said second heating member is started while the first recording material passes in the nip portion when a fixing operation is started.

3. The fixing apparatus according to claim 2, wherein said control means controls the abutting operations of said first and second heating members so that the first recording material enters the nip portion before a temperature of said first fixing rotating member increases by a predetermined temperature with heating by said first heating member and said second heating member abuts against said first fixing rotating member before the temperature of said first fixing rotating member reduces by a predetermined temperature with passing of the first recording material through the nip portion.

4. The fixing apparatus according to claim 1, further comprising a rotatable holding unit that holds said first and second heating members so as to move said first and second heating members between a heating position where said first and second heating members abut against said first fixing rotating member and a standby position where said first and second heating members are separated from said first fixing rotating member.

5. The fixing apparatus according to claim 1, further comprising a heater that heats said first fixing rotating member from the interior of said first fixing rotating member.

6. A fixing apparatus comprising:

elastic first and second fixing rotating members that fix a toner image on a recording material at a nip portion formed therebetweenp;

first and second heating members that abut an outer surface of said first fixing rotating member; and control means that controls pressing operations of said first and second heating members so that the pressing operation of said first heating member is started before a first recording material enters the nip portion and the pressing operation of said second heating member is started while the first recording material passes through the nip portion.

7. The fixing apparatus according to claim 6, wherein said control means controls the pressing operations of said first and second heating members so that the first recording material enters said nip portion before a temperature of said first fixing rotating member increases by a predetermined temperature with heating by said first and second heating members and the pressing operation of said second heating member is started before the temperature of said first fixing rotating member reduces by a predetermined temperature with passing of the first recording material through the nip portion.

8. The fixing apparatus according to claim 6, further comprising a rotatable holding unit that holds said first and second heating members so as to move between a first heating position and a second heating position at which a peripheral width of the pressing region between said first/second heating member and said first fixing rotating member is larger than that of the pressing region at the first heating position.

9. The fixing apparatus according to claim 6, further comprising a heater that heats said first fixing rotating member from the interior of said first fixing rotating member.

* * * * *

UNITED STATES PATENT AND TRADEMARK OFFICE

CERTIFICATE OF CORRECTION

PATENT NO. : 7,107,001 B2
APPLICATION NO. : 11/087706
DATED : September 12, 2006
INVENTOR(S) : Seiichiro Kameda It is certified that error appears in the above-identified patent and that said Letters Patent is hereby corrected as shown below:

COLUMN 3:
Line 1, “a” should be deleted.
Line 3, “a” should be deleted.
Line 18, “a” should be deleted.
Line 20, “a” should be deleted.

COLUMN 7:
Line 2, “has” should read --have--.
Line 45, “fast” should read --quickly--.

COLUMN 15:
Line 57, “a” should read --an--.

COLUMN 16:
Line 33, “therebetweenp;” should read --therebetween;--.

Signed and Sealed this

Tenth Day of July, 2007

JON W. DUDAS
*Director of the United States Patent and Trademark Office*